US006933828B2

(12) United States Patent
Puigcerver et al.

(10) Patent No.: US 6,933,828 B2
(45) Date of Patent: Aug. 23, 2005

(54) DEVICES AND METHODS FOR PROTECTING WINDINGS AROUND A SHARP EDGED CORE

(75) Inventors: Luis Orlando Puigcerver, Raleigh, NC (US); David Edwin Bowling, Fuquay-Varina, NC (US); Robert Paul Glembocki, Holly Springs, NC (US); Charles J. Connor, Jr., Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 256 days.

(21) Appl. No.: 09/877,654

(22) Filed: Jun. 8, 2001

(65) Prior Publication Data

US 2002/0190836 A1 Dec. 19, 2002

(51) Int. Cl.[7] ..... H01F 27/28

(52) U.S. Cl. ..... 336/229; 336/209; 336/216; 336/219; 336/82; 336/90

(58) Field of Search ..... 336/209, 216, 336/219, 229, 82, 83, 213, 90, 221

(56) References Cited

U.S. PATENT DOCUMENTS

| | | | | |
|---|---|---|---|---|
| 3,058,160 A | | 10/1962 | Mocker et al. | 18/47.5 |
| 3,681,516 A | | 8/1972 | Heinrichs, Jr. et al. | 174/138 E |
| 3,702,499 A | * | 11/1972 | Virsbreg | 29/605 |
| 3,710,293 A | | 1/1973 | Lazor | 336/198 |
| 4,877,567 A | | 10/1989 | Yoshizumi et al. | 264/153 |
| 5,138,393 A | * | 8/1992 | Okamura et al. | 335/297 |
| 5,179,776 A | | 1/1993 | Boenitz et al. | 29/609 |
| 5,353,494 A | * | 10/1994 | Bisbee et al. | 29/605 |
| 5,717,373 A | | 2/1998 | Vachris | 336/206 |
| 5,838,220 A | * | 11/1998 | Hagberg | 336/206 |
| 6,137,390 A | * | 10/2000 | Tung et al. | 336/83 |
| 6,259,347 B1 | * | 7/2001 | Sines | 336/219 |

OTHER PUBLICATIONS

International Search Report for PCT/US02/18615.

* cited by examiner

*Primary Examiner*—Elvin Enad
*Assistant Examiner*—Jennifer A. Poker
(74) *Attorney, Agent, or Firm*—Myers Bigel Sibley & Sajovec

(57) ABSTRACT

Electromagnetic devices are provided including an electrically conductive core having an inner diameter defining an opening therethrough and an outer diameter, the core having sharp edges extending circumferentially around the inner diameter and around the outer diameter thereof. A plurality of polymeric protection members are wrapped circumferentially around the core and positioned adjacent the sharp edges of the core. The protection members have a short leg positioned adjacent an end of the core. A coated wire is wrapped around the core so as to be magnetically coupled thereto and around the polymeric protection members so as to be displaced from the sharp edges of the core. Polymeric protection members and methods for manufacturing such members and for fabricating devices using such members are also provided.

47 Claims, 9 Drawing Sheets

DEVICES AND METHODS FOR PROTECTING WINDINGS AROUND A SHARP EDGED CORE

FIELD OF THE INVENTION

The present invention relates to protection devices and, more particularly, to devices and methods for protecting windings.

BACKGROUND OF THE INVENTION

A variety of different products are known which require wrapping of windings around a core member having an opening therein. Example of such products include electromagnetic sensor equipment and electrical transformers. Such products typically include a cylindrical shaped metal core having electrically conductive wires wrapped around the core.

As the conductive core and the electrically conductive wires typically must be isolated, the wires in such products are often coated, for example, with a varnish or other insulating coating. However, it is often desirable, for manufacturing and/or performance reasons, to utilize a sharp edged core with right angle interfaces at each of the outer and inner corner surfaces of the core around which the wires must be wrapped. These edges may cut into the wiring and undesirably introduce an electrically conductive path between the core and the wrapped wiring. Accordingly, various approaches have been proposed for protecting the wrapped wiring.

In one prior art approach, a non-conductive paper is placed around the core before the wire is wrapped around the core. For example, sheet cardboard may be cut to provide two circular portions with outer diameter and inner diameter values selected to correspond to the end faces of the core. A first and second rectangular strip are also cut with lengths corresponding to the circumference of the core at the respective outer diameter of the core and the diameter of the opening in the center of the core through which the wires will pass and a width corresponding to the width of the core between its end faces. These four pieces are then positioned around the outer surface of the core and taped in place. The wire (typically ranging from about 8 AWG to about 32 AWG) may then generally be safely wrapped around the core without damaging the insulating coating (for example, varnish) of the wire. However, due, in part, to the variety of different diameters (typically about 4 inches (10.16 centimeters) to about 44 inches (111.76 centimeters)) and widths (typically about 1.25 inches (3.175 centimeters) to about 8.5 inches (21.59 centimeters)) of the cores, a great deal of waste is typically encountered using the non-conductive paper wrapping. For example, the cut out of the center of the rings for the end pieces must, typically, be scrapped along with the outer portions of the material after the end pieces are cut out. The taping operation provides additional expense in materials and labor as well.

An alternative approach has been proposed in which a 90 degree plastic extrusion with two equal length sides is placed over the corners of the core. However, a problem with this approach is the tendency of the material to have uneven sides due to the wrapping of the extrusion around the circumference of the core, particularly on the edges of the inner opening of the core. This problem may be particularly acute for smaller diameter cores. In addition, an overlap of the ends of the extrusion to complete the wrap of the circumference without leaving any exposed sharp edges would result in an undesirable bump on the surface which, like the rippling caused by the wrapping of the extrusion into a circular configuration, could adversely affect performance of the finished electromagnetic product.

SUMMARY OF THE INVENTION

According to embodiments of the present invention, electromagnetic devices are provided including an electrically conductive core having an inner diameter defining an opening therethrough and an outer diameter, the core having sharp edges extending circumferentially around the inner diameter and around the outer diameter thereof. A plurality of polymeric protection members are wrapped circumferentially around the core and positioned adjacent the sharp edges of the core. An adhesive layer is positioned between the protection members and the core connecting the protection members to the core. A coated wire is wrapped around the core so as to be magnetically coupled thereto and around the polymeric protection members so as to be displaced from the sharp edges of the core.

In further embodiments of the present invention, electromagnetic devices are provided including an electrically conductive core having an inner diameter defining an opening therethrough and an outer diameter, the core having sharp edges extending circumferentially around the inner diameter and around the outer diameter thereof. A plurality of polymeric protection members are wrapped circumferentially around the core and positioned adjacent the sharp edges of the core. The protection members have at least one short leg positioned adjacent at least one end of the core. The short leg has a length selected to provide a substantially flat surface on the end of the core when the protection members are wrapped around the core. A coated wire is wrapped around the core so as to be magnetically coupled thereto and around the polymeric protection members so as to be displaced from the sharp edges of the core.

In other embodiments of the present invention, the protection members are L-shaped strips having a short leg positioned adjacent an end of the core and a long leg positioned adjacent a circumferential face of the core. The short leg has a length selected to provide a substantially flat surface on the end of the core. In alternative embodiments of the present invention, the protection members are channel shaped members having a width at least equal to a width of the core and a first and second leg at opposite sides thereof and a channel portion extending therebetween. The channel shaped members are wrapped around the core so as to position the first leg adjacent a first end of the core and the second leg adjacent an opposite end of the core with a circumferential face of the core positioned in the channel shaped member.

In further embodiments of the present invention, the adhesive layer is positioned adjacent the short leg of the protection members. The long leg and/or channel portion of the protection members may directly contact the core without an adhesive layer therebetween. The protection members may further include a first end and a second end thereof, the first end and second end defining mating angles at an overlapping region of the protection members when the protection members are wrapped around the core so as to extend around the entirety of one of the sharp edges of the core without a bump discontinuity at the overlapping region. The mating angles may be between about 15 degrees and 75 degrees and, in further embodiments, may be 45 degree angles.

In other embodiments of the present invention, the outer diameter of the core is at least about 5 centimeters (3 inches)

and the first and second leg each have a length of less than about 0.32 centimeters (0.125 inches). In further embodiments, the outer diameter of the core is at least about 22 centimeters (9 inches) and the first and second leg each have a length of less than about 1 centimeter (0.375 inches).

In further embodiments of the present invention, the protection members are a crosslinked polymeric material having a dielectric strength selected to limit breakdown of the protection members by magnetic fields generated around the core. The dielectric strength may be at least about 200 volts/centimeter. The polymeric material may be stable at 150 degrees Centigrade for at least about 100 hours. The crosslinked polymeric material may be either medium or high density polyethylene.

In a further aspect of the present invention, protection members are provided for a device including a sharp-edged core and elongate members wrapped therearound. The protection member is an L-shaped strip having a short leg configured to be positioned adjacent an end of the core, abutting a circumferentially extending sharp edge of the core, and a long leg extending substantially transversely from the short leg so as to be positioned adjacent a circumferential face of the core. The short leg has a length selected to provide a substantially flat surface on the end of the core when wrapped around the core. Alternatively, the protection members may be channel shaped members having a width at least equal to a width of the core and a first and second leg at opposite sides thereof and a channel portion extending therebetween, the channel shaped members being configured to be wrapped around the core so as to position the first leg adjacent a first end of the core and the second leg adjacent an opposite end of the core with a circumferential face of the core positioned in the channel shaped member. The first and second legs each have a length selected to provide a substantially flat surface on the end of the core when wrapped around the core. The device may be an electromagnetic device and the elongate members may be wires having an insulating coating thereon.

In yet another aspect of the present invention, methods are provided for assembling an electromagnetic device including a sharp-edged core and at least one wire wrapped therearound. Polymeric protection members are placed around sharp edges of the core extending circumferentially around an inner diameter and around an outer diameter of the core. The protection members have a short leg positioned adjacent an end of the core. The short leg has a length selected to provide a substantially flat surface on the end of the core when the protection members are wrapped around the core. A wire is wrapped around the core so as to be magnetically coupled thereto and around the polymeric protection members so as to be displaced from the sharp edges of the core. An adhesive layer may be placed on an inner surface of the polymeric protection members to secure the polymeric protection members to the core.

In another aspect of the present invention, methods are provided for fabricating a polymeric protection member for a device including a core having circumferentially extending sharp edges around an inner diameter and around an outer diameter thereof around which elongate members are wrapped. A circumferential length of one of the sharp edges is determined. A length of a polymeric protection strip stock is measured out corresponding to the determined circumferential length. The polymeric protection strip stock is cut to the measured length to provide the protection member. More particularly, the polymeric protection strip stock is cut at an angle selected to define mating angles at an overlapping region of the protection member when the cut protection member is wrapped around the core so as to extend around the entirety of one of the sharp edges of the core without a bump discontinuity at the overlapping region. The angle may be between about 15 degrees and about 75 degrees. The polymeric protection strip stock may have at least one short leg configured to be positioned adjacent at least one end of the core. The short leg may have a length selected to provide a substantially flat surface on the end of the core when the polymeric protection member is wrapped around the core.

In further embodiments of the present invention, electromagnetic devices are provided including an electrically conductive core having at least one circumferentially extending sharp edge. At least one polymeric protection member is wrapped circumferentially around the core and positioned adjacent the at least one circumferentially extending sharp edge of the core. The at least one protection member further includes a first end and a second end thereof, the first end and second end defining mating angles at an overlapping region of the at least one protection member when the protection member is wrapped around the core so as to extend around the entirety of the at least one circumferentially extending sharp edge of the core without a bump discontinuity at the overlapping region. An insulated wire is wrapped around the core so as to be magnetically coupled thereto and around the at least one polymeric protection member so as to be displaced from the at least one circumferentially extending sharp edge of the core. In such embodiments including mating angles, the protection member(s) may comprise L-shaped members with a short leg positioned adjacent an end face of the core and a long leg extending substantially transversely therefrom, channel shaped members, L-shaped members with the long leg positioned adjacent the end face of the core and/or angled members with equal length legs.

Objects of the present invention will be appreciated by those of ordinary skill in the art from a reading of the figures and the detailed description of the preferred embodiments which follow, such description being merely illustrative of the present invention.

BRIEF DESCRIPTION OF THE DRAWINGS

The accompanying drawings which form a part of the specification, illustrate key embodiments of the present invention. The drawings and description together serve to fully explain the invention. In the drawings.

DETAILED DESCRIPTION OF THE PREFERRED EMBODIMENTS

Figure 1:
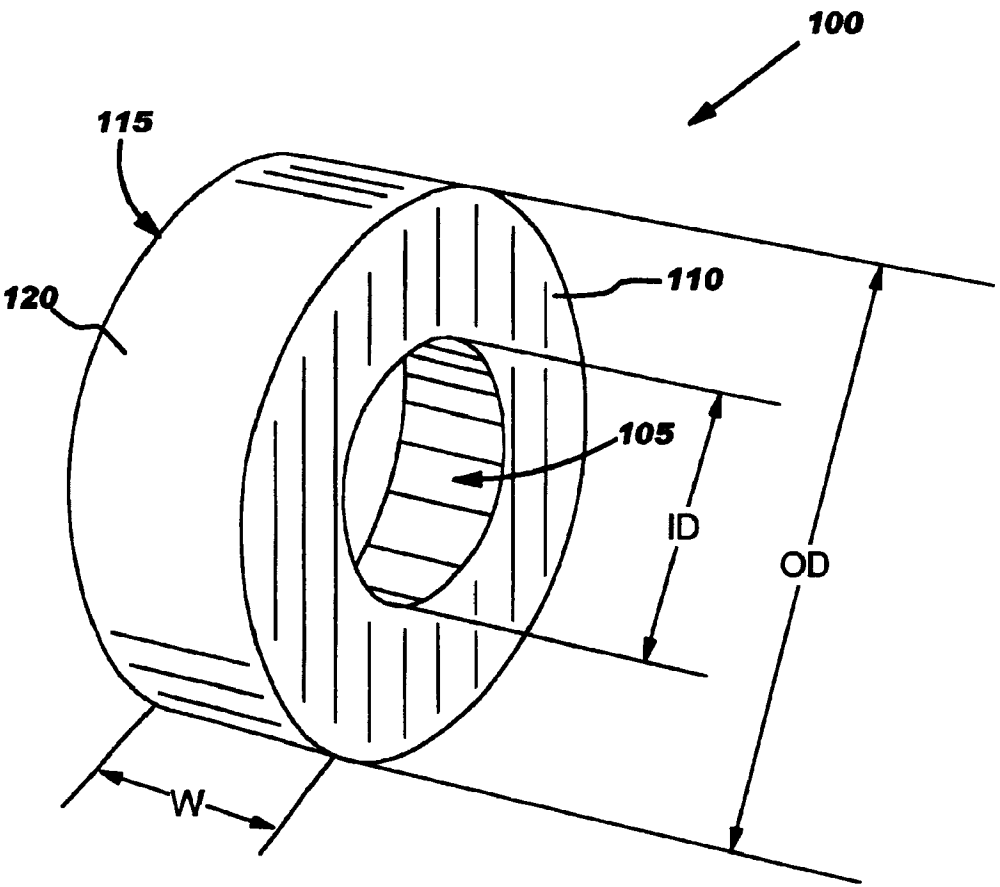
Figure 1 (Prior Art)
FIG. 1 is a perspective view of a core of an electromagnetic device.

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements throughout. The terms "upwardly", "downwardly", "vertical", "horizontal" and the like are used herein for the purpose of explanation only.

Referring now to FIG. 1, a core of a device, such as an electromagnetic device, with which protection members of the present invention may be used, will be described to provide a background for further describing the present invention. As shown in the embodiment of FIG. 1, a generally cylindrical core 100 is illustrated. However, it is to be understood that the core need not be circular in profile and may take on other shapes, such as elliptical or other shapes having circumferentially extending sharp edges. For the purposes of simplicity and understanding of the present invention, however, the description of the present invention herein will generally make reference to a circular profile core such as that illustrated in FIG. 1.

As shown in FIG. 1, the core 100 includes an inner diameter (ID) defining an opening 105 through the core 100. The core is further defined by an outer diameter (OD). Two end (or side) faces 110, 115 are illustrated displaced from each other by a width (W). A circumferential face 120 extends around the core which has a width (W) and a length corresponding to the circumference of the core 100.

Figure 2:
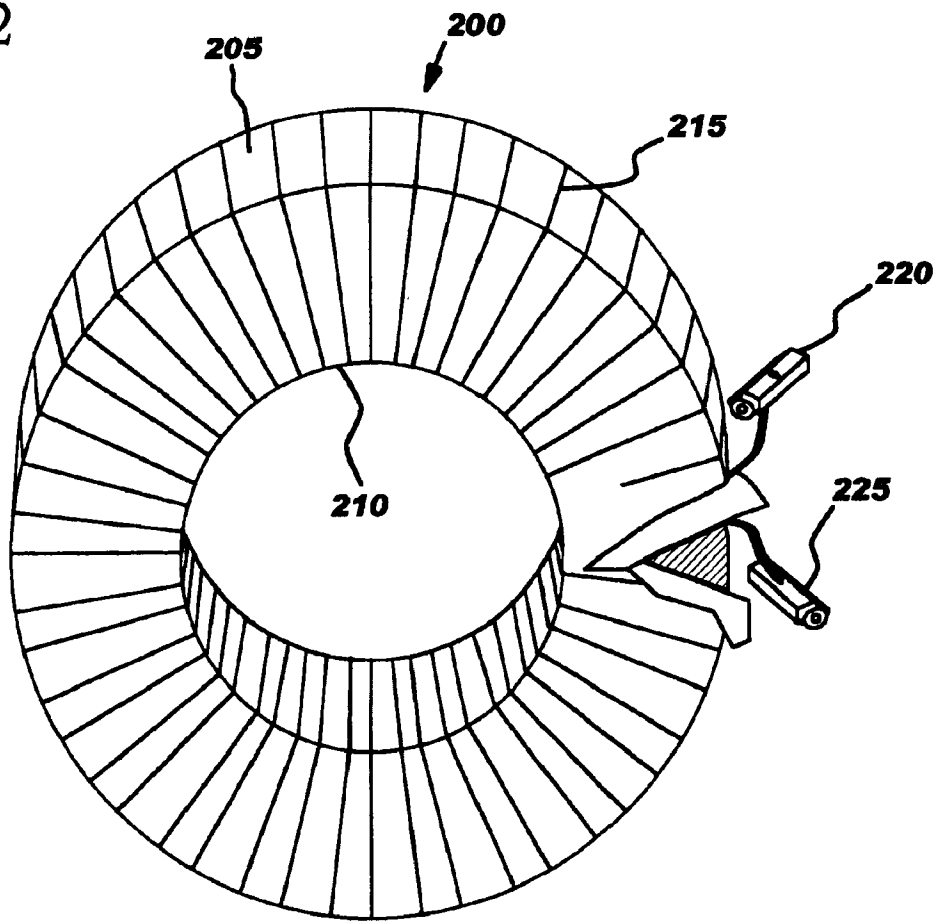
Figure 2 (Prior Art)
FIG. 2 is a perspective view of an electromagnetic device including the core of FIG. 1.

An electromagnetic device 200 including a core such as that shown in FIG. 1 is illustrated in FIG. 2. The electromagnetic device 200 includes a non-conductive paper wrapped core 205 and an inner diameter defining an opening 210 therethrough. One or more wires 215 are wrapped around the core 205 and terminate in respective end connectors 220, 225. It is to be understood that the electromagnetic device 200 as shown in FIG. 2 includes a conventional non-conductive paper wrap for protecting the wires 215 from contact with the circumferentially extending sharp edges at the inner diameter and outer diameter of the core 205. Such wires may be provided with an insulating coating, such as a varnish.

Figure 3A:
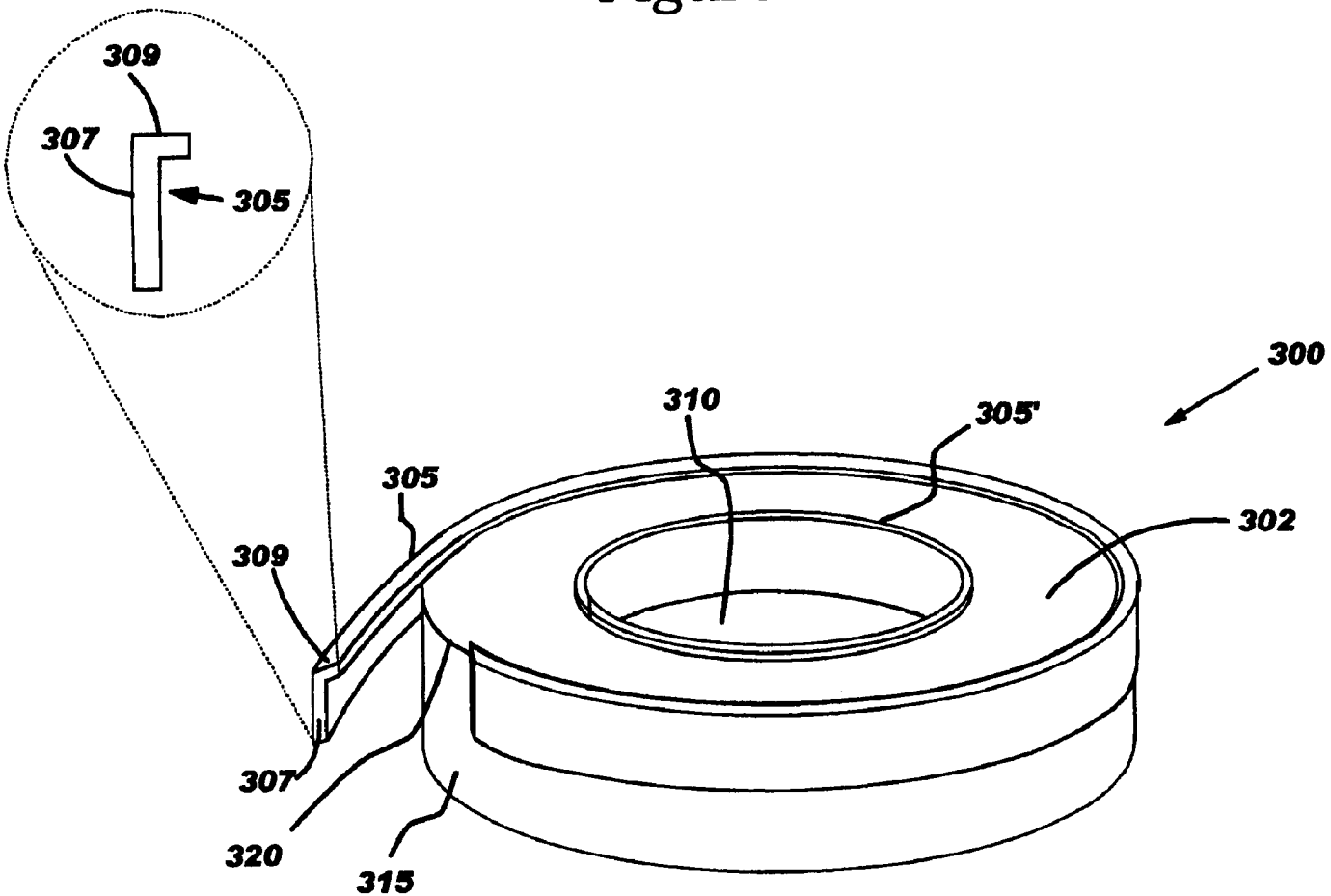
FIG. 3A is a perspective view of a protection member partially wrapped around a core of an electromagnetic device according to embodiments of the present invention.

Referring now to the illustration of FIG. 3A, embodiments of protective members in accordance with the present invention being wrapped around a sharp edged core will be further described. FIG. 3A illustrates a partial assembly 300 including, on the top face of a core 302 as shown in FIG. 3A, a circumferentially extending sharp edge along an inner diameter 310 covered by first protective member 305'. A second circumferentially extending sharp edge 320 is illustrated extending around the outer diameter of the core 302. A circumferentially extending face 315 of the core 302 extends between the end or side shown as the top of the assembly 300 in FIG. 3 and the opposite end which is not visible in FIG. 3A. A protection member 305 is partially wrapped around the edge 320 in FIG. 3A. As shown in FIG. 3A, the protection member 305 is an L-shaped strip having a short leg positioned adjacent the end or side face of the core 302 and a long leg (i.e., longer than the short leg) positioned adjacent the circumferential face 315 of the core 302. Preferably, the short leg 309 has a length selected to provide a substantially flat surface on the end (or side) of the core 302. The long leg 307 may have a length selected to facilitate mounting and retention of the L-shaped member 305 on the core 302.

Figure 3B:
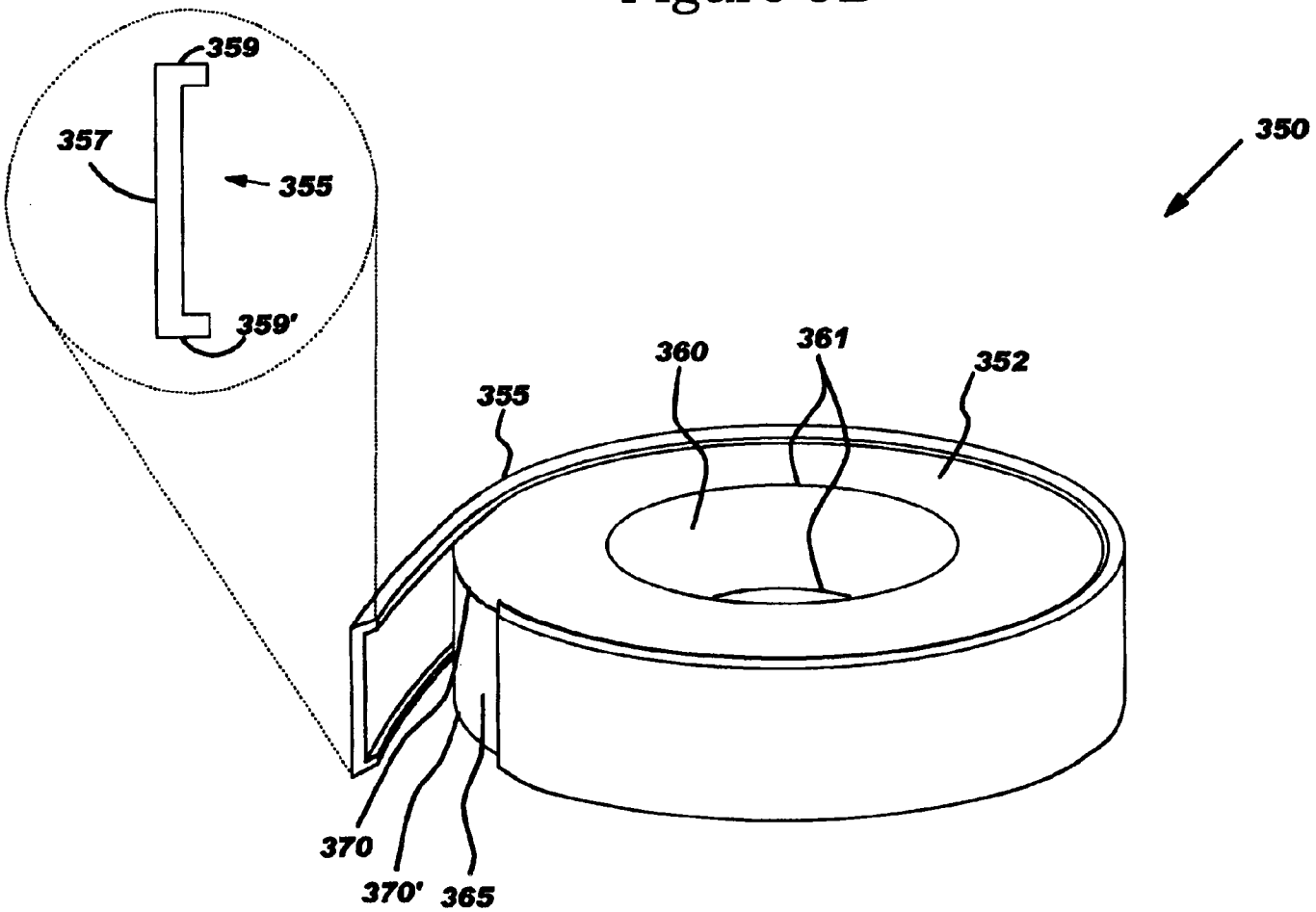
FIG. 3B is a perspective view of a protection member partially wrapped around a core of an electromagnetic device according to further embodiments of the present invention.

Referring now to FIG. 3B, further embodiments of protection members for wrapping around sharp edged cores will now be described. As shown in FIG. 3B, the assembly 350 includes a single protection member 355 partially wrapped around the outer diameter of a core 352. The core 352 includes an inner diameter defining an opening 360 therethrough. The core 352 includes two circumferentially extending sharp edges 370, 370' extending around the outer circumference of the core 352 with a circumferential face 365 therebetween.

As shown for the embodiments of FIG. 3B, the protection member 355 is a channel or rail shaped member having a width at least equal to the width of the circumferential face 365 of the core 352 so as to slip or press fit over the face 365 of the core 352. The channel shaped protection member 355 includes a first leg 359 and a second leg 359' at opposite sides thereof and a channel portion 357 extending between the first and second legs, 359, 359'. The channel shaped protection member 355 is wrapped around the core 352 so as to position the first leg 359 adjacent the top end/side of the core 352 along the sharp edge 370 and to place the second leg 359' adjacent an opposite end/side of the core 352 defining the second sharp edge 370'. The circumferential face 365 of the core 352 is positioned within the channel defined by the channel shaped member 355 abutting the channel portion 357. While no protection member 355 is shown covering the sharp edges defined by the inner diameter around the opening 360 in FIG. 3B, it is to be understood that the protection member 355 may be inverted and provided in a different length but, otherwise, be applied in the same manner to protect the inner diameter circumferentially extending sharp edges 361 as described with respect to the outer sharp edges 370, 370'.

The respective ends of the protection member 355 define mating angles which will overlap when the protection member 355 is fully wrapped around the core 352 so as to extend the protection member 355 around the entirety of the sharp edges 370, 370' without a bump discontinuity being presented in the overlapping region. For the embodiment illustrated in FIG. 3B, the mating angle is a 45 degree angle as will be further described with reference to FIG. 4C.

The protection member 305 or 355 may be provided as an extruded plastic profile. As will be further described herein, the extruded profile can also have one surface coated with a high tack adhesive or other mastic bonding substrate to provide an adhesive layer for coupling the protection member 305, 355 to the core. Such an extruded profile may be supplied as a continuous wrap reeled, for example, on a large spool.

For electromagnetic devices, such as sensors or transformers, a broad range of outer diameters for the core may be encountered. It is preferred that the legs 309, 359, 359' adjacent the end faces of the core in such devices have lengths selected to provide a substantially flat surface on the ends of the core when the protection members 305, 355 are wrapped around the core. More particularly, an excessive length of the legs 309, 359, 359', relative to the bend radius introduced based on the diameter of the core where the protection member is utilized, may cause a ripping of the leg 309, 359, 359' along the ends which may be undesirable for the performance of the resulting device. In various embodiments of the present invention, where the outer diameter (i e., the diameter at which the protection member is to be applied) is at least about 5 centimeters (3 inches), the short leg has a length of less than about 0.32 centimeters (0.125 inches). In further embodiments, the outer diameter of the core is at least about 22 centimeters (9 inches) and the short leg has a length of less than about 2 centimeters (¾ inches) and, more preferably, less than about 1 centimeter (0.375 inches). The protection member may have a material thickness of between about 1 millimeter and about 3 millimeters.

The adhesive layer between the protection member 305, 355 and the core 302, 352 may be positioned adjacent the short leg 309, 359, 359' of the protection members 305, 355. The long leg 307 of the protection member 305 and/or the channel portion 357 of the protection member 355 may directly contact the core without an adhesive layer therebetween in various embodiments of the present invention.

The material used in the forming of the protection members 305, 355 may be a crosslinked polymeric material. The crosslinked polymeric material preferably has a dielectric strength selected to limit breakdown of the protection members by magnetic fields generated around the core. The dielectric strength may, for example, be at least about 200 volts/centimeter and, more preferably, may be about 217 volts/centimeter with a material thickness of 1.27 millimeters for the protection members. The crosslinked polymeric material may be a medium or high density polyethylene material or other suitable material.

Further material properties for the protection members 305, 355 which may be beneficial in various applications include heat stability at 150 degrees Centigrade for at least about 100 hours and, more preferably, for about 168 hours. The thermal endurance of the polymeric material may be about 20,000 hours at 105 degrees Centigrade. The abrasion resistance for the polymeric crosslinked material may be 20% maximum material loss after 1,000 cycles at 2068 grams. The crosslinked polymeric material may further have a low temperature impact resistance down to about −20 degrees Centigrade.

Figures 4A, 4C:
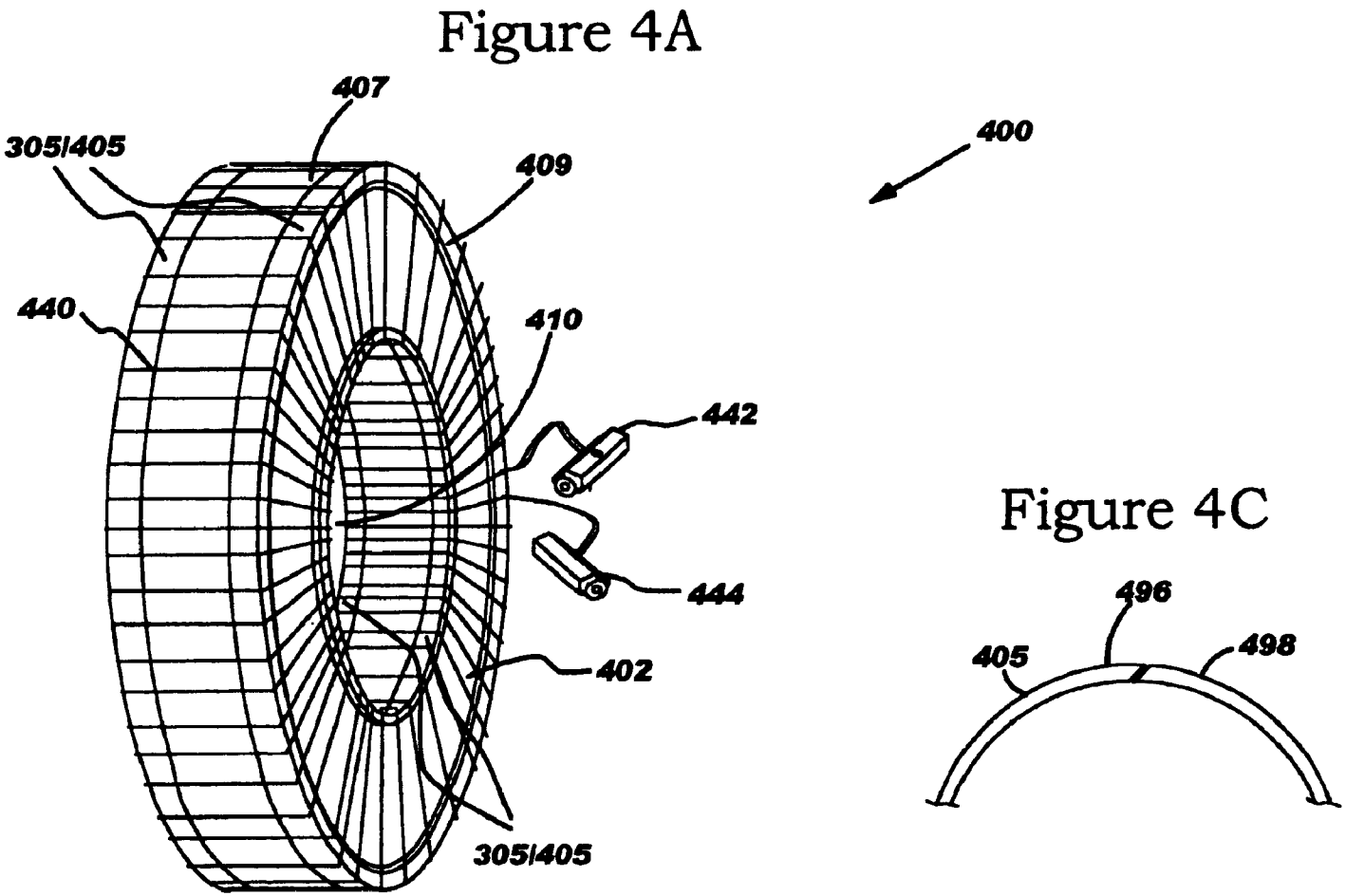
FIG. 4A is a perspective view of an electromagnetic device including protection members according to embodiments of the present invention.
FIG. 4C is a side elevational view of the overlap point of one of the protection devices illustrated in FIG. 4A.
Figure 4B:
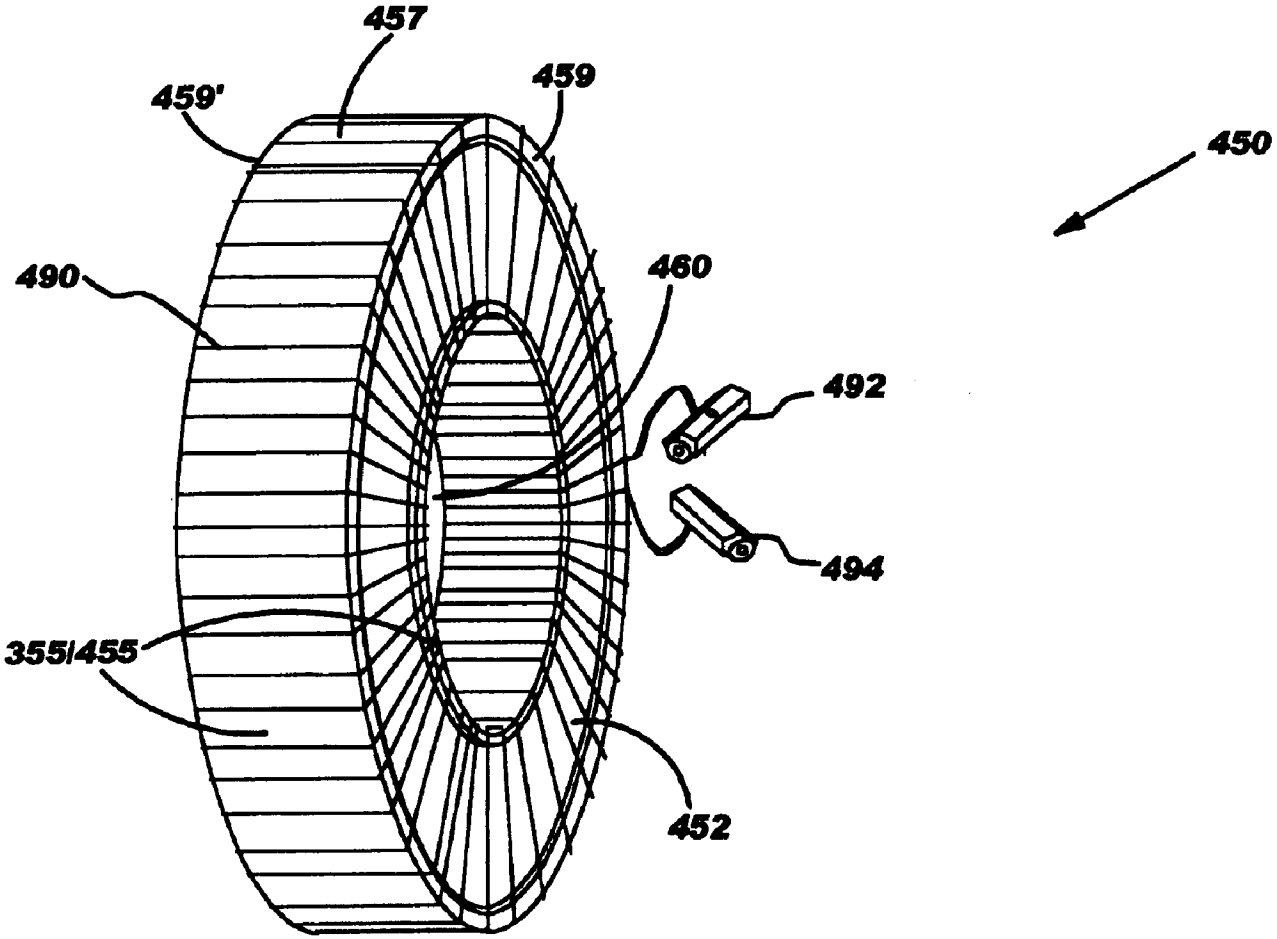
FIG. 4B is a perspective view of an electromagnetic device including protection members according to further embodiments of the present invention.

Referring now to the illustration of FIG. 4A, the assembly 300 of FIG. 3A with protection members 305 positioned around all sharp edges of the core 302 and a wire 440 wrapped therearound 400 is illustrated. The wire 440 further includes end connectors 442, 444. Otherwise, like numbered elements 407, 409, 410 shown in FIG. 4A correspond to similarly numbered elements 307, 309, 310 of FIG. 3A and will not be further described herein. Similarly, FIG. 4B illustrates the assembly 350 of FIG. 3B with a protection member 355 fully positioned around both the outer diameter sharp edges and the inner diameter sharp edges and a wire 490 wrapped thereabouts. The wire 490 includes end connectors 492, 494. Otherwise, like numbered elements 450, 452, 455, 457, 459, 460 shown in FIG. 4B correspond to those 350, 352, 355, 357, 359, 360 described and shown in FIG. 3B and will not be described further herein.

FIG. 4C is a side elevational view of the overlap point of one of the outer diameter protection members illustrated in FIG. 4A as noted in FIG. 4A. As shown in FIG. 4C, a first end 496 and a second end 498 of a protection member 405 define mating angles at an overlapping region of the protection member when the protection member is wrapped around the core. Thus, the protection member is able to extend around the entirety of the sharp edge of the core without a bump discontinuity at the overlapping region and, further, without any exposed sharp edge portion which might otherwise cause abrasion to a wire wrapped therearound. As shown in FIG. 4C, the mating angles comprise 45 degree angles. It is to be understood that use of angles from about 15 degrees to about 75 degrees may be particularly advantageous in providing a simplified manufacturing methodology for providing protection member strips of a desired length which may be used interchangeably around inner or outer diameter features of a core to which the protection members are to be applied.

Figure 5A:
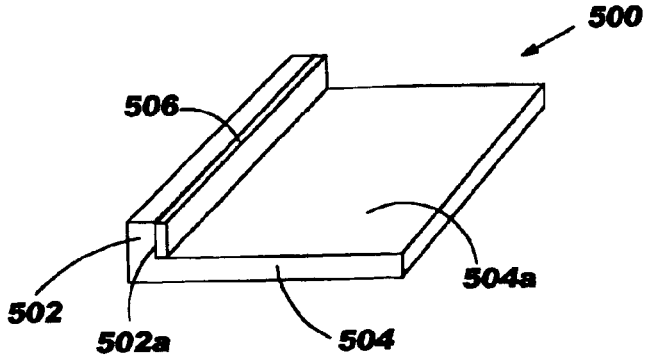
FIG. 5A is a perspective view of a protection member according to embodiments of the present invention.
Figure 5B:
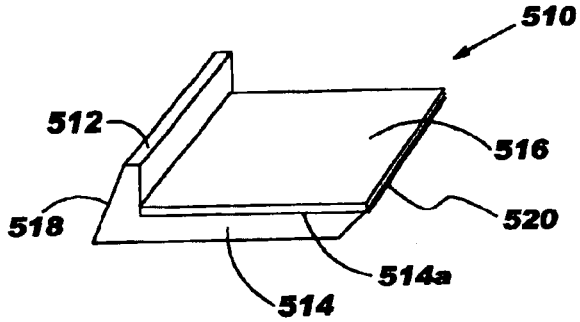
FIG. 5B is a perspective view of a protection member according to further embodiments of the present invention.

Substantially L-shaped protection members in accordance with various embodiments of the present invention are further illustrated in FIGS. 5A and 5B. As shown in FIG. 5A, the L-shaped protection member 500 includes a short leg 502 and a long leg 504 extending substantially transversely therefrom. An adhesive layer 506 is positioned along an inner surface 502*a* of the short leg 502 while no adhesive layer is shown on the inner surface 504*a* of the long leg 504 for the embodiments illustrated in FIG. 5A.

Referring now to FIG. 5B, further embodiments of L-shaped protection members according to the present invention will now be further described. The protection member 510 in FIG. 5B includes a short leg 512 and a long leg 514. For the embodiments illustrated in FIG. 5B an adhesive layer 516 is placed along the inner surface 514*a* of the long leg 514 which adhesive layer 516 may alternatively be provided along the inner surfaces of both the short leg 512 and the long leg 514 and may further, alternatively, be placed first on the core before application of the protection members to provide an adhesive layer therebetween. Furthermore, the embodiments illustrated in FIG. 5B differ from those shown in FIG. 5A in that they include tapered surfaces 518 and 520 provided by having the short leg 512 and the long leg 514 narrow at the ends thereof. Such a taper may be utilized to facilitate wrapping of an elongate member, such as a coated wire, around the protection members when they are installed on a core.

Figure 6:
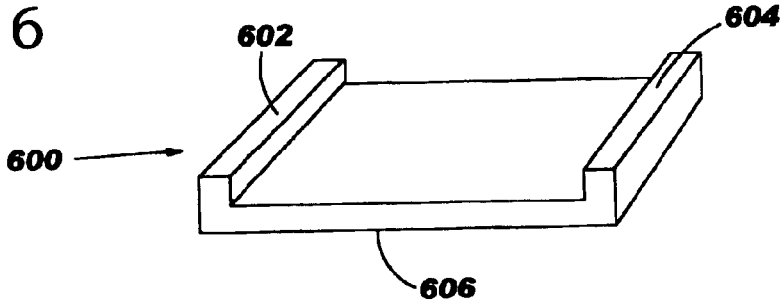
FIG. 6 is a perspective view of a protection member according to yet further embodiments of the present invention.

A section of strip stock defining a protection member having a channel or rail shape according to embodiments of the present invention, such as those illustrated in FIG. 3B, is further illustrated in FIG. 6. As shown in FIG. 6, the protection member 600 includes a first leg 602, a second leg 604 at an opposite end therefrom and a channel portion 606 extending therebetween. While not shown in FIG. 6, it is to be understood that an adhesive layer may be presented on the inner surface of the first 602 and second 604 leg and/or the channel portion 606.

Figure 7:
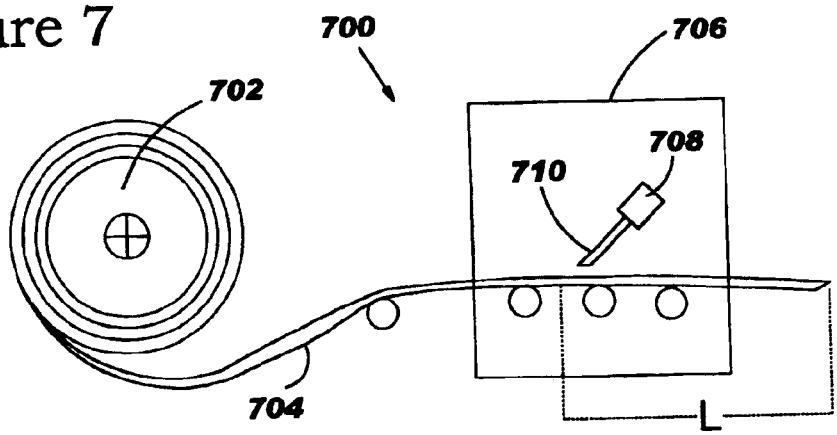
FIG. 7 is a side elevational view of a protection member fabrication apparatus according to embodiments of the present invention.

Referring now to FIG. 7, an apparatus for fabricating a polymeric protection member in accordance with the present invention will now be described. The apparatus 700 includes a spool 702 having a length of extruded crosslinked polymeric material 704 having a profile shaped in either an L-shaped or a channel shape as described previously. The extruded polymeric material 704 is fed from the spool 702 into a cutting station 706, for example, utilizing a motor drive and rotation of the spool 702. The cutting station 706 includes a cutting tool 708 having a cutting blade 710 positioned at an angle alpha ($\alpha$) relative to the plane over which the polymeric material 704 travels through the cutting station 706. A desired length (L) of material, for example, a length corresponding to the circumferential length of the sharp edge to be protected, is measured out in the cutting station 706 and a cut is made at the angle α through the material 704 by the cutting blade 710. The strip 704 is then advanced a desired length for a next piece to be fabricated and again cut at the angle α. Thus, each strip cut in the cutting station 706 is provided with first and second ends defining mating angles for use in an overlapping region of the protection members when the protection members are wrapped around a core so as to facilitate providing a mating region without a bump discontinuity in the overlapping area.

Figure 8:
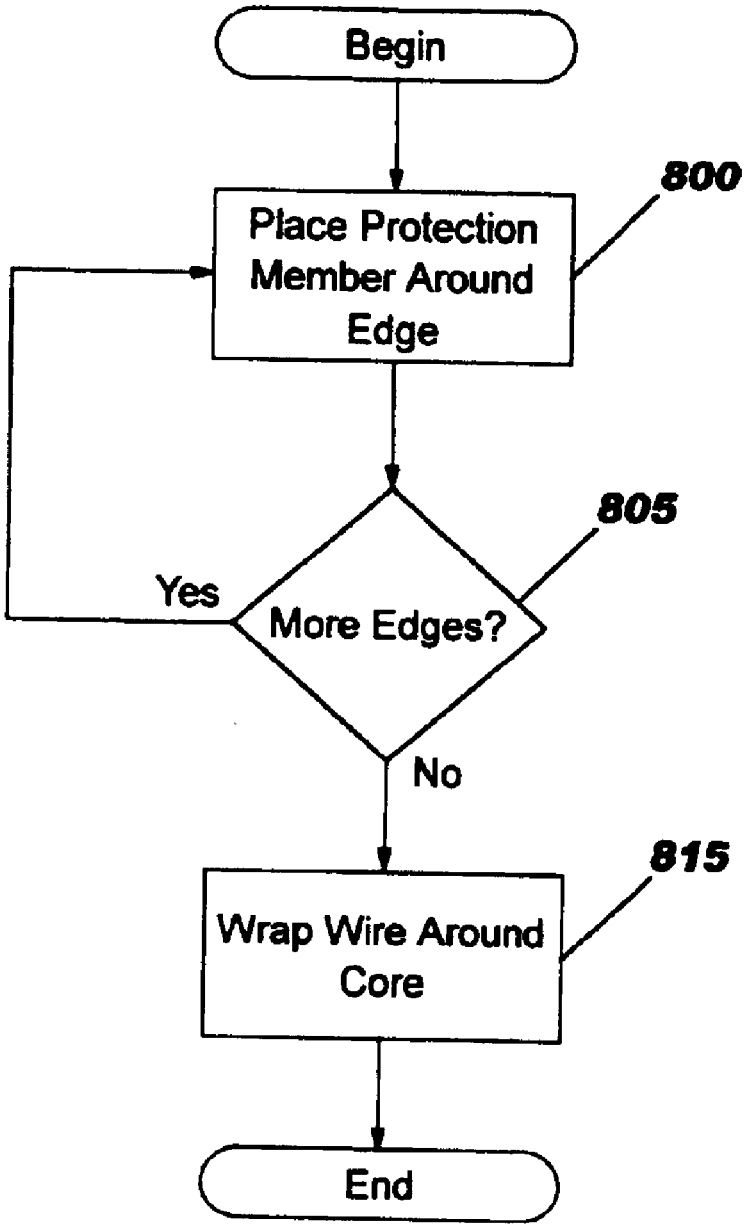
FIG. 8 is a flowchart illustrating operations for assembling an electromagnetic device according to embodiments of the present invention.

Referring now to FIG. 8, operations related to assembling an electromagnetic device including a sharp edged core and at least one wire wrapped thereon according to embodiments of the present invention will now be further described. Operations begin at block 800 by placing a polymeric protection member around a sharp edge of the core which extends circumferentially around an inner diameter or an outer diameter of the core. If more circumferentially sharp edges exist on the core which have not yet been covered (block 805), protection members are placed around such other edges (block 800). The protection members, as described previously with reference to FIGS. 3A and 3B through 6, include at least one short leg position adjacent to an end of the core. The short leg has a length selected to provide a substantially flat surface on the end of the core when the protection member is wrapped around the core. One or more wires are then wrapped around the core (block 815). The wires are wrapped around the core so as to be magnetically coupled thereto. They are further wrapped around the outer surfaces of the polymeric protection members so as to be displaced from the sharp edges of the core.

In various embodiments, the protection members may be applied directly to the core by resting an inner surface thereof against the sharp edges defined in a perimeter of the core. Each of the protection members may be cut to a length that matches the circumference of the inner or outer diameter to be protected before applying the protective strips to the sharp edges. In further embodiments, an adhesive layer may be placed on an inner surface of the polymeric protection members before placing them on the core so as to secure the protection members to the core. Alternatively, or in addition to the adhesive layer, a tape, such as a glass tape, may be wrapped around the protection members before the wire is wrapped around the core.

Figure 9:
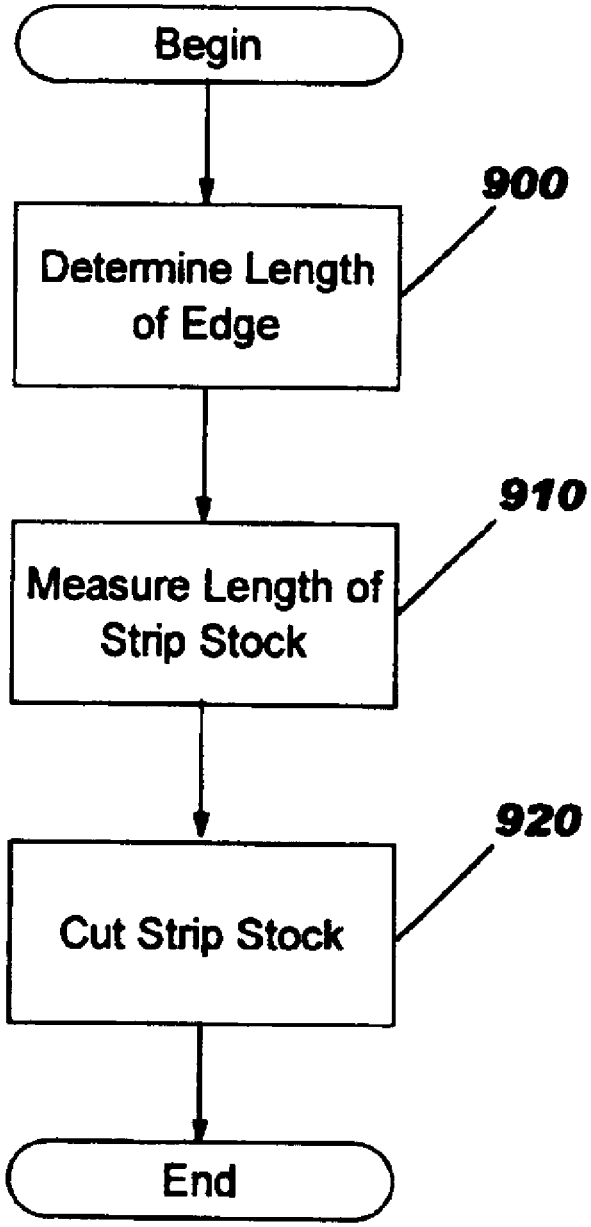
FIG. 9 is a flowchart illustrating operations for fabricating a protection member according to embodiments of the present invention.

Referring now to FIG. 9, methods for fabricating a polymeric protection member for a device including a core having circumferentially extending sharp edges around an inner diameter and around an outer diameter thereof around which elongate members are wrapped will now be described for various embodiments of the present invention. Note that the device may be an electromagnetic device and the elongate member may be a wire or wires wrapped around the conductive core of the electromagnetic device.

Operations begin by determining a circumferential length of one of the sharp edges of the core (block 900). A length of a polymeric protection strip stock corresponding to the determined circumferential length is measured out (block 910). The polymeric protection strip stock is cut to the measured length to provide the protection member (block 920). The polymeric protection strip stock is cut at an angle selected to define mating angles at an overlapping region of the protection member when the cut protection member is wrapped around the core. This may provide for a protection member which extends around the entirety of one of the sharp edges of the core without a bump discontinuity being introduced at the overlapping region where the ends of the polymeric protection strip stock meet. An apparatus such as that illustrated in FIG. 7 above may be suitable for use in carrying out the method described with reference to FIG. 9.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. An electromagnetic device comprising:

an electrically conductive core having an inner diameter defining an opening therethrough and an outer diameter, the core having sharp edges extending circumferentially around the inner diameter and around the outer diameter thereof;

a plurality of polymeric protection members wrapped circumferentially around the core and positioned adjacent the sharp edges of the core;

an adhesive layer between the protection members and the core connecting the protection members to the core;

a coated wire wrapped around the core so as to be magnetically coupled thereto and around the polymeric protection members so as to be displaced from the sharp edges of the core; and wherein at least one of the protection members further comprises a first end and a second end thereof, the first end and second end defining mating angles at an overlapping region of the protection members when the protection members are wrapped around the core so as to extend around all of one of the sharp edges of the core without a bump discontinuity at the overlapping region.

2. The device of claim 1 wherein the protection members comprise L-shaped strips having a short leg positioned adjacent an end of the core and a long leg positioned adjacent a circumferential face of the core, wherein the short leg has a length selected to provide a substantially flat surface on the end of the core.

3. The device of claim 2 wherein the outer diameter of the core is at least about 5 centimeters and wherein the length of the short leg is less than about 0.32 centimeters.

4. The device of claim 2 wherein the outer diameter of the core is at least about 22 centimeters and wherein the length of the short leg is less than about 1 centimeters.

5. The device of claim 2 wherein the adhesive layer is positioned adjacent the short leg of the protection members.

6. The device of claim 5 wherein the long leg of the protection members directly contacts the core without an adhesive layer therebetween.

7. The device of claim 1 wherein the mating angles are between about 15 degrees and about 75 degrees.

8. The device of claim 1 wherein the protection members comprise a crosslinked polymeric material having a dielectric strength selected to limit breakdown of the protection members by magnetic fields generated around the core.

9. The device of claim 1 wherein the dielectric strength is at least about 200 volts/centimeter.

10. The device of claim 1 wherein the polymeric material is stable at 150 degrees Centigrade for at least about 100 hours.

11. The device of claim 1 wherein the crosslinked polymeric material comprises either medium or high density polyethylene.

12. The device of claim 1 wherein the polymeric protection members are wrapped around the core without a wire therebetween.

13. The device of claim 1 wherein at least one of the polymeric protection members extends circumferentially around all of a corresponding one of the sharp edges.

14. The device of claim 1 wherein the polymeric protection members prevent the coated wire from contacting the sharp edges.

15. The device of claim 1 wherein the polymeric protection members adhesively contact the core.

16. An electromagnetic device comprising:

an electrically conductive core having an inner diameter defining an opening therethrough and an outer diameter, the core having sharp edges extending circumferentially around the inner diameter and around the outer diameter thereof;

a plurality of polymeric protection members wrapped circumferentially around the core and positioned adjacent the sharp edges of the core, at least one of the protection members having at least one short leg positioned adjacent at least one end of the core, wherein the short leg has a length selected to provide a substantially flat surface on the end of the core when the at least one protection members is wrapped around the core;

a coated wire wrapped around the core so as to be magnetically coupled thereto and around the polymeric protection members so as to be displaced from the sharp edges of the core; and wherein ones of the protection members further comprises a first end and a second end thereof, the first end and second end defining mating angles at an overlapping region of the protection members when the protection members are wrapped around the core so as to extend around all of one of the sharp edges of the core without a bump discontinuity at the overlapping region.

17. The device of claim 16 wherein the protection members comprise a crosslinked polymeric material having a dielectric strength selected to limit breakdown of the protection members caused by magnetic fields generated around the core.

18. The device of claim 17 wherein the dielectric strength is at least about 200 volts/centimeter.

19. The device of claim 17 wherein the polymeric material is stable at 150 degrees Centigrade for at least about 100 hours.

20. The device of claim 17 wherein the crosslinked polymeric material comprises either medium or high density polyethylene.

21. The device of claim 16 wherein the protection members comprise L-shaped strips having the at least one short leg positioned adjacent an end of the core and a long leg extending substantially transversely from the short leg and positioned adjacent a circumferential face of the core.

22. The device of claim 16 wherein the mating angles are between about 15 degrees and about 75 degrees.

23. The device of claim 16 wherein the outer diameter of the core is at least about 5 centimeters and wherein the at least one short leg has a length of less than about 0.32 centimeters.

24. The device of claim 16 wherein the outer diameter of the core is at least about 22 centimeters and wherein the at least one short leg each has a length of less than about 1 centimeters.

25. The device of claim 16 wherein at least one of the polymeric protection members contacts the core.

26. The device of claim 16 wherein the polymeric protection members are wrapped around the core without a wire therebetween.

27. The device of claim 16 wherein at least one of the polymeric protection members extends circumferentially around all of a corresponding one of the sharp edges.

28. The device of claim 16 wherein the polymeric protection members prevent the coated wire from contacting the sharp edges.

29. The device of claim 16 wherein the polymeric protection members adhesively contact the core.

30. A protection member for a device including a sharp-edged core and an elongate member wrapped therearound, the protection member comprising a polymeric L-shaped strip having a short leg configured to be positioned adjacent an end of the core, abutting a circumferentially extending sharp edge of the core, and a long leg extending substantially transversely from the short leg so as to be positioned adjacent a circumferential face of the core, wherein the short leg has a length selected to provide a substantially flat surface on the end of the core when wrapped around the core; and wherein the protection member further comprises a first end and a second end thereof, the first end and second end defining mating angles at an overlapping region of the protection member when the protection member is wrapped around the core so as to extend around all of the sharp edge of the core without a bump discontinuity at the overlapping region.

31. The device of claim 30 wherein the outer diameter of the core is at least about 5 centimeters and wherein the at least one short leg has a length of less than about 0.32 centimeters.

32. The device of claim 30 wherein the outer diameter of the core is at least about 22 centimeters and wherein the at least one short leg each has a length of less than about 1 centimeters.

33. The device of claim 30 wherein an adhesive layer is positioned adjacent an inner surface of the short leg.

34. The device of claim 30 wherein the protection member comprises a crosslinked polymeric material having a dielectric strength selected to limit breakdown of the protection member caused by magnetic fields generated around the core.

35. The device of claim 34 wherein the dielectric strength is at least about 200 volts/centimeter.

36. The device of claim 34 wherein the polymeric material is stable at 150 degrees Centigrade for at least about 100 hours.

37. The device of claim 34 wherein the crosslinked polymeric material comprises either medium or high density polyethylene.

38. The device of claim 30 wherein the device comprises an electromagnetic device and wherein the elongate members comprise wires having an insulating coating thereon.

39. The device of claim 30 wherein the mating angles are between about 15 degrees and about 75 degrees.

40. The protection member of claim 30 wherein the elongate member has a length selected to extend circumferentially around all of the circumferentially extending sharp edge of the core.

41. An electromagnetic device comprising:

an electrically conductive core having at least one circumferentially extending sharp edge;

at least one polymeric protection member wrapped circumferentially around the core and positioned adjacent the at least one circumferentially extending sharp edge of the core, the at least one protection member further comprising a first end and a second end thereof, the first end and second end defining mating angles at an overlapping region of the at least one protection member when the protection member is wrapped around the core so as to extend around all of the entirety of the at least one circumferentially extending sharp edge of the core without a bump discontinuity at the overlapping region; and an insulated wire wrapped around the core so as to be magnetically coupled thereto and around the at least one polymeric protection member so as to be displaced from the at least one circumferentially extending sharp edge of the core.

42. The device of claim 41 wherein the mating angles are between about 15 degrees and about 75 degrees.

43. The device of claim 42 wherein the at least one circumferentially extending sharp edge comprises a plurality of circumferentially extending sharp edges and wherein the at least one protection member comprises a plurality of protection members.

44. The device of claim 41 wherein the at least one polymeric protection member is wrapped around the core without a wire therebetween.

45. The device of claim 41 wherein the at least one polymeric protection member prevents the insulated wire from contacting the at least one circumferentially extending sharp edge.

46. The device of claim 41 wherein the polymeric protection members adhesively contact the core.

47. The device of claim 41 wherein the at least one polymeric protection member contacts the core.

* * * * *